US010071882B2

(12) United States Patent
Duvall

(10) Patent No.: US 10,071,882 B2
(45) Date of Patent: Sep. 11, 2018

(54) ELEVATOR SAFETY CLAMPING JAW

(71) Applicants: ThyssenKrupp Elevator AG, Essen (DE); ThyssenKrupp AG, Essen (DE)

(72) Inventor: Jeff Duvall, Woodstock, GA (US)

(73) Assignees: ThyssenKrupp AG, Essen (DE); ThyssenKrupp Elevator AG, Essen (DE)

( * ) Notice: Subject to any disclaimer, the term of this patent is extended or adjusted under 35 U.S.C. 154(b) by 395 days.

(21) Appl. No.: 14/547,723

(22) Filed: Nov. 19, 2014

(65) Prior Publication Data

US 2016/0137456 A1 May 19, 2016

(51) Int. Cl.
*B66B 5/18* (2006.01)
*B66B 5/22* (2006.01)

(52) U.S. Cl.
CPC . *B66B 5/18* (2013.01); *B66B 5/22* (2013.01)

(58) Field of Classification Search
CPC ..... B66B 5/18; B66B 5/22
See application file for complete search history.

(56) References Cited

U.S. PATENT DOCUMENTS 619,227 A * 2/1899 Rogers ..... B66B 5/18 187/375
637,396 A * 11/1899 Lindstrom ..... B66B 5/18 187/375
676,152 A * 6/1901 Pratt ..... B66B 5/18 187/375
974,414 A 11/1910 Mohnike
1,351,827 A * 9/1920 Barker ..... B66B 5/18 187/375
1,874,754 A * 8/1932 James ..... B66B 5/282 187/343
1,929,680 A 10/1933 Dunlop
2,716,467 A * 8/1955 Callaway ..... B66B 5/22 187/376
3,762,512 A * 10/1973 McIntyre ..... B66B 5/22 187/372
3,972,392 A * 8/1976 Johnson ..... B60T 13/22 188/170

FOREIGN PATENT DOCUMENTS

| | | | |
|---|---|---|---|
| CH | 684190 | A5 | 7/1994 |
| CN | 1106764 | A | 8/1995 |
| CN | 101365645 | A | 2/2009 |
| CN | 103723595 | A | 4/2014 |
| DE | 102005053835 | A1 | 5/2007 |
| EP | 0921332 | A1 | 6/1999 |

* cited by examiner

*Primary Examiner* — Minh Truong
(74) *Attorney, Agent, or Firm* — The Webb Law Firm

(57) ABSTRACT

A safety clamping jaw includes at least one lever arm, a wedge member provided on a first end of each lever arm, a roller provided on a second end of each lever arm, a cam member provided between the rollers, and a resilient member bearing against the cam member. Upon activation of the clamping jaw, each roller may push the cam member in a direction towards the resilient member, thereby compressing the resilient member.

19 Claims, 4 Drawing Sheets

ELEVATOR SAFETY CLAMPING JAW

BACKGROUND OF THE INVENTION

Field of the Invention

This disclosure relates generally to a clamping jaw for use with an elevator and, more particularly, to a safety gear clamping jaw for use with an elevator.

Description of Related Art

Clamping jaws used for applying a clamping or braking force to a guide rail for elevator arrangements are generally known in the art. Through rotation of lever arms or jaws positioned adjacent the guide rail, the lever arms may apply the clamping or braking force to the guide rail. These pre-existing clamping jaws often include various components that create a high mass, slow-moving arrangement. During operation of a high speed elevator, it is necessary that the clamping jaws are capable of quickly and efficiently applying a clamping or braking force to the guide rail of an elevator arrangement to decelerate or stop the elevator. Due to the high speeds experienced by the elevators, any small delay in applying the clamping or braking force can result in an extended distance that the elevator will travel until the elevator is slowed or stopped. Pre-existing clamping jaws, however, are often heavy units that include long lever arms used to effect the clamping or braking force of the clamping jaw. Due to the heavy mass and the slow movement of these clamping jaws, the clamping jaws are not well suited for the quick response time necessary for high speed elevators.

For elevators with very high mass and high passenger capacity, the clamping or braking force from the safety gear must be very high as well. This often requires large and heavy components (castings, weldments, wedges, springs, etc.) that can create such a large clamping or braking force. Therefore, minimizing space requirements and component masses are desirable for high speed elevator applications. Also, it is desirable for high speed elevators to minimize the masses of moving components within the clamping mechanism to reduce acceleration stresses and mechanism overshoot that can occur during safety gear activation. Mechanism overshoot can lead to chattering of the safety wedges of the clamping device. The chattering can cause reduced performance of the safety gear and can cause damage to safety gear components. Pre-existing clamping jaws, however, are unable to provide such features to alleviate these problems concerning elevators and, in particular, high speed elevators.

An example of one such preexisting clamping jaw configuration is disclosed in U.S. Pat. No. 1,929,680 to Dunlop, incorporated herein by reference in its entirety. The quick acting safety grip is activated upon a rope unspooling from a drum located on the safety grip. The drum in turn rotates a screw housed in the safety grip that pushes a cam member between two rollers disposed on each end of a pair of clamping jaws. The cam member is pushed along the rollers, causing the proximal ends of the clamping jaws to separate from one another while causing the distal ends of the clamping jaws to apply a clamping force to a guide rail of the elevator. This safety grip is actuated upon a governor unspooling the rope from the drum, thereby causing the cam member to be pushed against the rollers of the clamping jaws. The safety grip requires a pull force from the governor to generate the clamping force to stop the elevator and to stay engaged after initial activation of the safety grip.

Further, the clamping force is not directly adjustable. It can only be adjusted by changing the pull force of the governor. The clamping force may also fluctuate due to a lower governor pull force due to wear of the governor parts. Therefore, the deceleration rate of the elevator may not be constant. Further, due to the high masses of the components in the safety grip, the safety grip is not suited for use in high speed elevators. The high activation delay time creates dangerous and unsafe operating conditions for high speed elevators.

SUMMARY OF THE INVENTION

In view of the foregoing, a need exists for a clamping jaw with low mass components that provides a high clamping or braking force to a guide rail of an elevator. A further need exists for a clamping jaw that permits adjustment of the clamping or braking force based on the capacity and speed of the elevator. A further need exists for a clamping jaw that applies a constant clamping or braking force to the guide rail of the elevator so as to provide a constant rate of deceleration. A further need exists for a clamping jaw that has a short activation delay time that enables use of the clamping jaw on a high speed elevator.

In accordance with one aspect, a safety clamping jaw includes at least one lever arm, a wedge member provided on a first end of each lever arm, a roller provided on a second end of each lever arm, a cam member provided between the rollers, and a resilient member bearing against the cam member. Upon activation of the clamping jaw, each roller may push the cam member in a direction towards the resilient member, thereby compressing the resilient member.

The at least one lever arm may include a first lever arm and a second lever arm. The cam member may include a first angled surface and a second angled surface. The roller provided on the first lever arm may bear against the first angled surface and the roller provided on the second lever arm may bear against the second angled surface. The resilient member may include a spring. A retaining member may extend through the at least one lever arm, the cam member, and the resilient member to hold the clamping jaw together. Each wedge member may include a first end and a second end. The first end of each wedge member may have a larger cross-sectional area than the second end of each wedge member. Each lever arm may be rotatable about a pivot point provided on each corresponding lever arm. All of the lever arms may be rotatable about a same pivot point. At least one lever arm may be fixed relative to the safety clamping jaw and at least one lever arm may be rotatable about a pivot point. A roller bearing may be positioned on a first end of each lever arm. Each roller bearing may be positioned between the first end of each lever arm and each wedge member positioned on the first end of each lever arm. Each wedge member may include a high friction material.

In accordance with another aspect, an elevator arrangement includes at least one guide rail, and at least one safety clamping jaw provided adjacent each guide rail. The at least one safety clamping jaw may include at least one lever arm, a wedge member provided on a first end of each lever arm, a roller provided on a second end of each lever arm, a cam member provided between the rollers, and a resilient member bearing against the cam member. Upon activation of the at least one clamping jaw, each roller pushes the cam member in a direction towards the resilient member, thereby compressing the resilient member.

The at least one lever arm may include a first lever arm and a second lever arm. The cam member may include a first angled surface and a second angled surface. The roller provided on the first lever arm may bear against the first angled surface and the roller provided on the second lever arm may bear against the second angled surface. The resilient member may include a spring. A retaining member may extend through the at least one lever arm, the cam member, and the resilient member to hold the clamping jaw together. Each wedge member may include a first end and a second end. The first end of each wedge member may have a larger cross-sectional area than the second end of each wedge member. Each lever arm may be rotatable about a pivot point provided on each corresponding lever arm. All of the lever arms may be rotatable about a same pivot point. At least one lever arm may be fixed relative to the safety clamping jaw and at least one lever arm may be rotatable about a pivot point. A roller bearing may be positioned on a first end of each lever arm. Each roller bearing may be positioned between the first end of each lever arm and each wedge member positioned on the first end of each lever arm. Each wedge member may include a high friction material.

In accordance with a further aspect, a method of decelerating an elevator arrangement using a safety clamping jaw includes the steps of providing an elevator arrangement, the elevator arrangement including at least one guide rail and at least one safety clamping jaw provided adjacent each guide rail, the at least one safety clamping jaw including at least one lever arm, a wedge member provided on a first end of each lever arm, a roller provided on a second end of each lever arm, a cam member provided between the rollers, and a resilient member bearing against the cam member; moving each wedge member in a direction substantially parallel to each corresponding guide rail to bring each wedge member in contact with each corresponding guide rail, thereby clamping each wedge member against each corresponding guide rail. A further step may include rotating the lever arms relative to one another; pushing the rollers along a length of the cam member. A further step may include pushing the cam member against the resilient member. A further step may include compressing the resilient member.

Further details and advantages will be understood from the following detailed description read in conjunction with the accompanying drawings.

DESCRIPTION OF THE DISCLOSURE

For purposes of the description hereinafter, spatial orientation terms, as used, shall relate to the referenced embodiment as it is oriented in the accompanying drawings, figures, or otherwise described in the following detailed description. However, it is to be understood that the embodiments described hereinafter may assume many alternative variations and configurations. It is also to be understood that the specific components, devices, features, and operational sequences illustrated in the accompanying drawings, figures, or otherwise described herein are simply exemplary and should not be considered as limiting.

The present disclosure is directed to, in general, a clamping jaw for an elevator and, in particular, to a high speed safety gear clamping jaw for a high-speed elevator. Certain preferred and non-limiting aspects of the components of the clamping jaw are illustrated in FIGS. 1-6.

Figure 1:
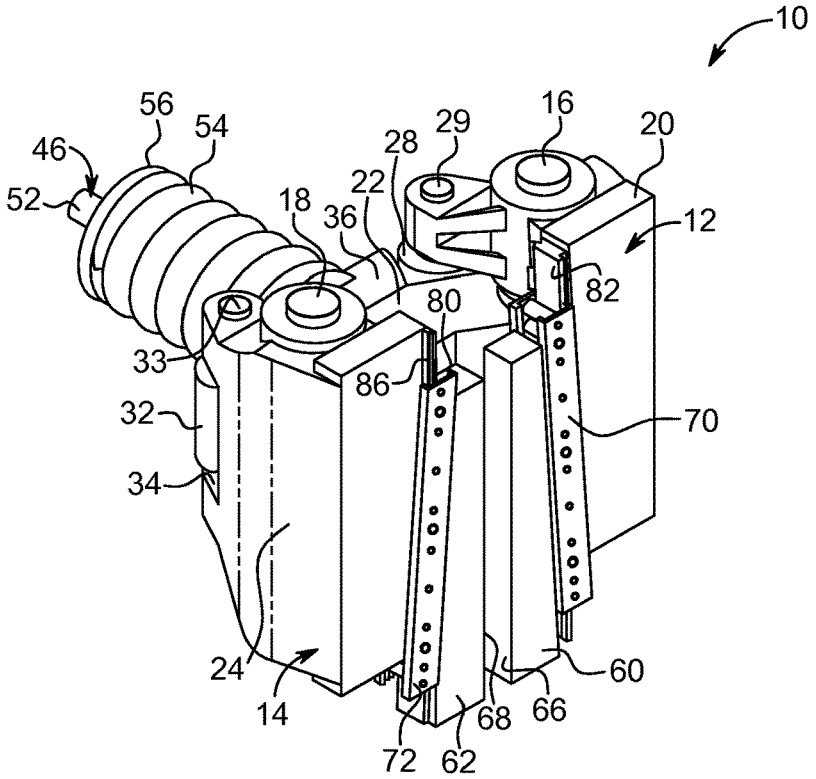
FIG. 1 is a front perspective view of a clamping jaw in accordance with an aspect of this disclosure.
Figure 2:
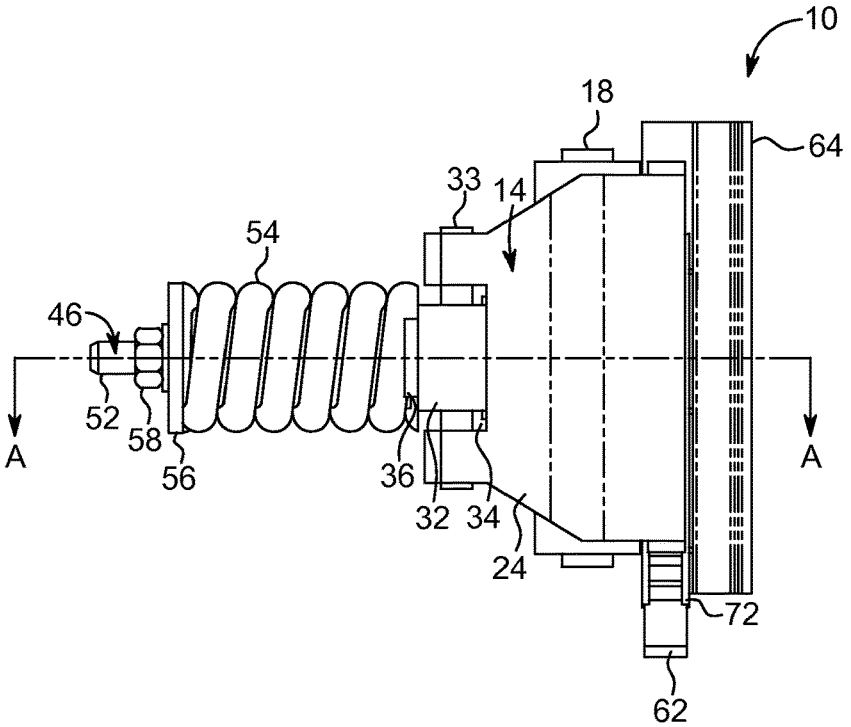
FIG. 2 is a side view of the clamping jaw of FIG. 1.
Figure 3:
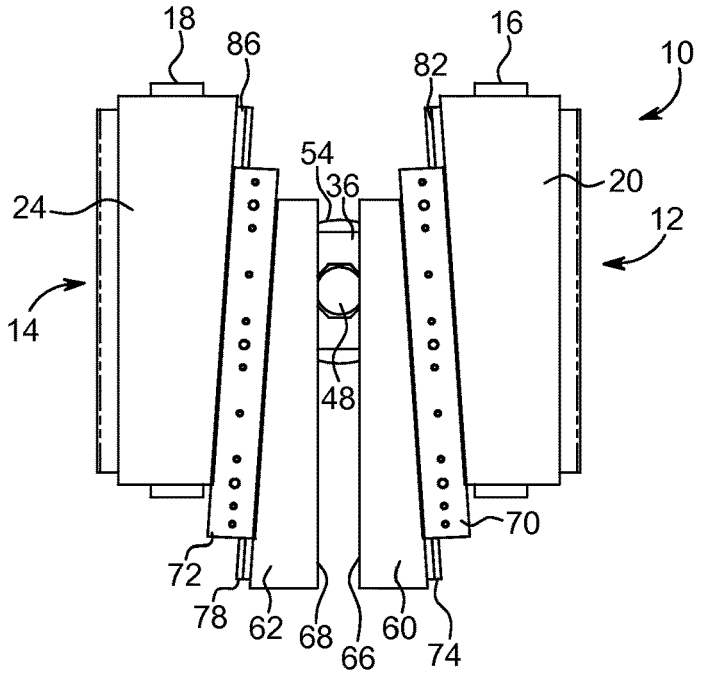
FIG. 3 is a front view of the clamping jaw of FIG. 1.

With reference to FIGS. 1-3, a high speed safety clamping jaw 10 (hereinafter referred to as "clamping jaw 10") is shown. A detailed description of the operation and use of the clamping jaw 10 is provided hereinbelow. The clamping jaw 10 is desirably adapted for use in an elevator arrangement (not shown). As will be described in greater detail below, the clamping jaw 10 is configured to assist in improving the deceleration rate of an elevator and, in particular, a high speed elevator. The clamping jaw 10 may include a first lever arm 12 and a second lever arm 14 that are rotatable about a first pivot point 16 and a second pivot point 18, respectively. In one aspect, the first lever arm 12 and the second lever arm 14 act as levers that translate radial movement of the lever arm into linear movement of a corresponding element of the clamping jaw 10. The lever arms 12, 14 may also be referred to together as "jaws". It is also contemplated that the clamping jaw 10 may include one lever arm. In another aspect, the clamping jaw 10 may include one lever arm 12 that rotates and one lever arm 14 that remains fixed or stationary relative to the clamping jaw 10. It is also contemplated that, instead of fixing the second lever arm 14, another fixed component may be used in conjunction with one lever arm. The first lever arm 12 may include an outer body member 20 and an inner body member 22. The outer and inner body members 20, 22 may be formed as separate pieces connected to one another. The outer body member 20 may be substantially L-shaped. Likewise, the second lever arm 14 may include an outer body member 24 and an inner body member 26. The outer and inner body members 24, 26 may be formed as separate pieces connected to one another. The outer body member 24 may be substantially L-shaped. The inner body members 22, 26 may extend inwardly from the outer body members 20, 24.

Figure 4:
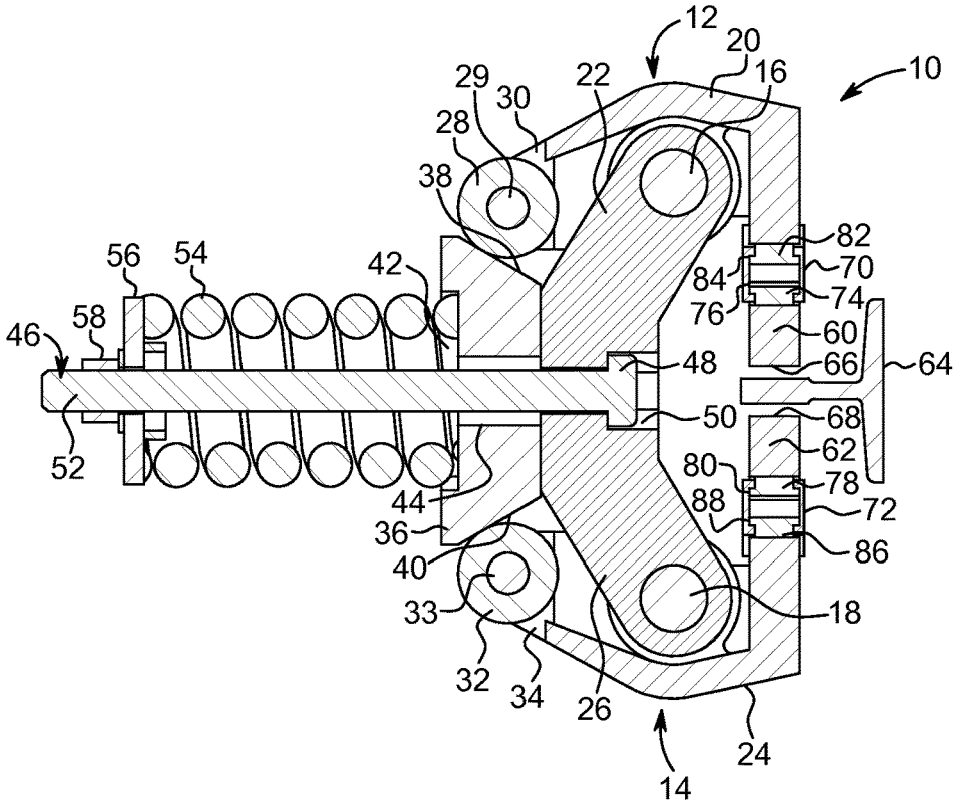
FIG. 4 is a cross-sectional view of the clamping jaw of FIG. 2 along line A-A in an unclamped position.
Figure 5:
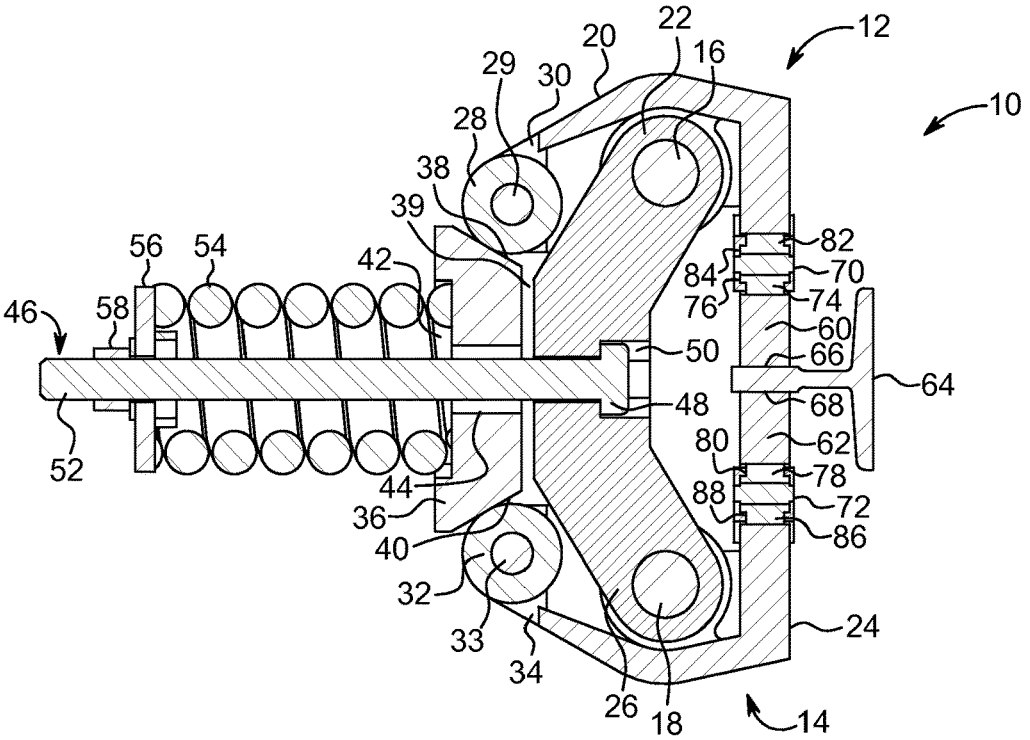
FIG. 5 is a cross-sectional view of the clamping jaw of FIG. 2 along line A-A in a clamped position.

As shown in FIGS. 1, 2, 4, and 5, a first roller 28 may be provided in a recess 30 defined by the first lever arm 12. Likewise, a second roller 32 may be provided in a recess 34 defined by the second lever arm 14. The recesses 30, 34 may be defined by outer body members 20, 24, respectively. The first and second rollers 28, 32 may be rotatably mounted in the recesses 30, 34 to permit the first and second rollers 28, 32 to spin freely within the recesses 30, 34. In one aspect, the first and second rollers 28, 32 may be mounted in the recesses 30, 34 with the use of a first pin 29 and a second pin 33, respectively. The first and second rollers 28, 32 may bear against a cam member 36 provided between the first lever arm 12 and the second lever arm 14. In one aspect, to bear against may mean to press or rest against an object, such as the cam member 36. The cam member 36 may include a first angled surface 38 and a second angled surface 40. The first roller 28 may be configured to move or roll along the length of the first angled surface 38. The second roller 32 may be configured to move or roll along the length of the second angled surface 40. The cam member 36 may define a first recess 42 on a first side and a second recess 44 through the cam member 36. The first recess 42 may be defined in a first surface of the cam member 36 that faces away from the first and second lever arms 12, 14 or towards a rear side of the clamping jaw 10. The second recess 44 may extend through the cam member 36 from a front or second surface of the cam member 36 to the rear or first surface of the cam member 36. As shown in FIG. 5, in one aspect, a gap 39 may be established and held open between the cam member 36 and the inner body members 22, 26 of the first and second lever arms 12, 14 when the clamping jaw 10 is in a clamped position to permit a maximum clamping or braking force applied by the first and second lever arms 12, 14. It is also contemplated that the clamping jaw 10 may include one roller mounted in one recess of a lever arm.

With continued reference to FIGS. 1, 2, 4, and 5, a retaining member 46 may be configured to hold the first lever arm 12 and the second lever arm 14 against the cam member 36. In one aspect, the retaining member 46 may be a bolt or similar type of rod or pin. In one aspect, a head 48 of the retaining member 46 may be inserted and held in a cavity 50 defined by the inner bodies 22, 26 of the first and second lever arms 12, 14. A shaft 52 of the retaining member 46 may extend from the cavity 50 through the second recess 44 of the cam member 36. A first end of a resilient member 54 may be positioned in the first recess 42 of the cam member 36. The shaft 52 of the retaining member 46 may also pass through an inner cavity extending through the resilient member 54. In one aspect, the resilient member 54 may be a spring. The resilient member 54 may be pre-loaded according to the size and weight of the elevator on which the clamping jaw 10 is installed to ensure the necessary clamping or braking force is applied by the clamping jaw 10. It is to be understood that alternative types of resilient members may be used in place of the spring, such as a deformable piece of rubber or a resilient metal element. By inserting the retaining member 46 through the first and second lever arms 12, 14, through the cam member 36, and through the resilient member 54, the retaining member 46 may be tightened to hold together the components of the clamping jaw 10.

The resilient member 54 may include the first end positioned in the first recess 42 of the cam member 36 and a second end that bears against a plate member 56. The plate member 56 may include an aperture through which the shaft 52 of the retaining member 46 may be inserted. In one aspect, the plate member 56 may be circular. It is to be understood, however, that the plate member 56 may be of any alternative shape, such as trapezoidal, triangular, or oval-shaped. The resilient member 54 may be positioned in between the cam member 36 and the plate member 56. During operation of the clamping jaw 10, as the cam member 36 is moved towards the plate member 56, the resilient member 54 may be compressed. An adjustment nut 58 may be threadedly fastened to an end of the shaft 52 of the retaining member 46. The adjustment nut 58 may be rotated to either push the plate member 56 closer to the cam member 36 or move the plate member 56 away from the cam member 36. By using the retaining member 46 and the adjustment nut 58, the first and second lever arms 12, 14, the cam member 36, the resilient member 54, and the plate member 56 may be held together as a unit to form the clamping jaw 10. The adjustment nut 58 may be adjusted to tighten the components of the clamping jaw 10 together at different positions.

With reference to FIGS. 1-5, a first wedge member 60 and a second wedge member 62 are shown on the clamping jaw 10. The first and second wedge members 60, 62 may be configured to provide a clamping or braking force to a guide rail 64 of an elevator arrangement. The guide rail 64 may extend along the longitudinal length of an elevator shaft in a building. The elevator arrangement may be configured to move or ride along the guide rail 64. It is contemplated that the elevator arrangement may ride along two separate guide rails. The first and second wedge members 60, 62 may be made from a high friction material, such as a brake pad, that is capable of applying a high frictional braking force to the guide rail 64 when the first and second wedge members 60, 62 are pressed against the guide rail 64. It is also contemplated that alternative types of materials may be used for the first and second wedge members 60, 62 that would be equally effective in applying a clamping or braking force to the guide rail 64, such as composite materials, ceramics, cast metals, or powdered metals. The first and second wedge members 60, 62 may include inclined bearing surfaces 66, 68, respectively. The bearing surfaces 66, 68 may bear or press against the guide rail 64 to effect a braking force to the guide rail 64. In one aspect, the first and second wedge members 60, 62 are wider at a bottom surface than at an upper surface. In other words, the cross-sectional area of the first and second wedge members 60, 62 may be greater at a bottom portion of the first and second wedge members 60, 62 than at an upper portion of the first and second wedge members 60, 62 so as to create the inclined bearing surfaces 66, 68.

As explained with reference to FIGS. 1 and 4, the first and second wedge members 60, 62 may be provided on the clamping jaw 10 using a first roller bearing 70 and a second roller bearing 72, respectively. The first and second roller bearings 70, 72 may include a plurality of cylindrical rolling elements that permit an object to easily and quickly move or slide along a length of the roller bearings 70, 72. The first wedge member 60 may include an extension member 74 that is configured to slide into a channel 76 defined by the first roller bearing 70. Likewise, the second wedge member 62 may include an extension member 78 that is configured to slide into a channel 80 defined by the second roller bearing 72. In one aspect, the extension members 74, 78 may have a T-shaped cross-section that corresponds to a cross-sectional shape of the channels 76, 80 of the first and second roller bearings 70, 72, respectively. However, it is to be understood that any corresponding shapes may be used between the extension members 74, 78 and the channels 76, 80 to retain the extension members 74, 78 in the channels 76, 80 of the roller bearings 70, 72. The first and second wedge members 60, 62 may be slidable within the first and second roller bearings 70, 72, respectively. In this configuration, the first and second wedge members 60, 62 may be pulled or pushed up through the first and second roller bearings 70, 72, respectively, or pulled or pushed down through the first and second roller bearings 70, 72. In a similar manner, the first lever arm 12 may also include an extension member 82 that extends from one end of the first lever arm 12. The extension member 82 may be configured for insertion into another channel 84 defined by the first roller bearing 70. Likewise, the second lever arm 14 may include an extension member 86 that extends from one end of the second lever arm 14. The extension member 86 may be configured for insertion into another channel 88 defined by the second roller bearing 72. In one aspect, the extension members 82, 86 may have a T-shaped cross-section that corresponds to a cross-sectional shape of the channels 84, 88 of the first and second roller bearings 70, 72. However, it is to be understood that any corresponding shapes may be used between the extension members 82, 86 and the channels 84, 88 to retain the extension members 82, 86 in the channels 84, 88 of the roller bearings 70, 72. Using this arrangement, the first and second roller bearings 70, 72 are permitted to slide upwards or downwards relative to the first and second lever arms 12, 14, respectively. It is also contemplated that the clamping jaw may include one lever arm with one wedge member for effecting a stopping force on a guide rail.

Figure 6:
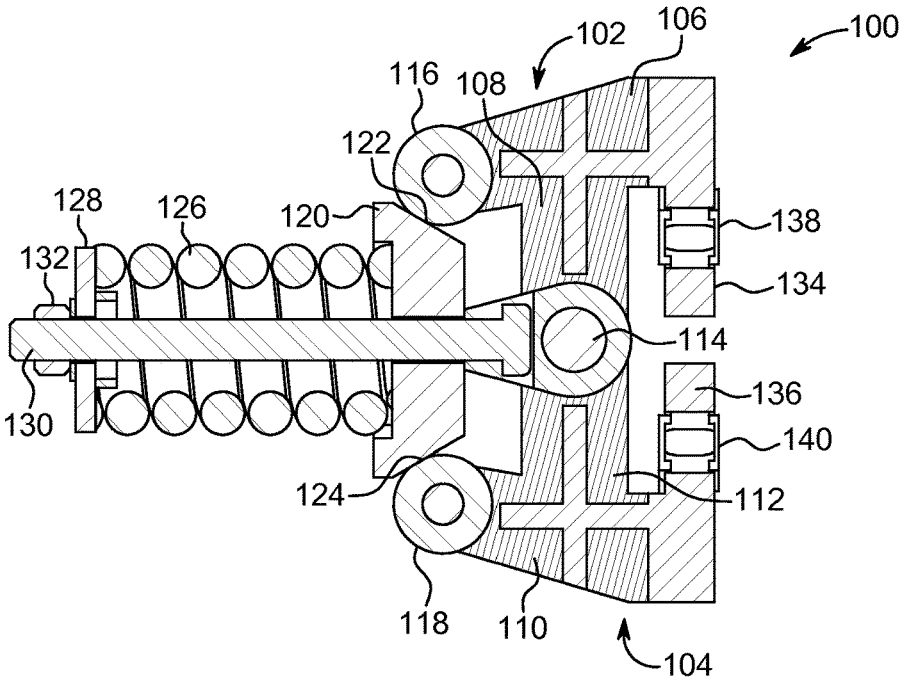
FIG. 6 is a cross-sectional view of a clamping jaw in accordance with another aspect of this disclosure.

With reference to FIG. 6, another embodiment of the clamping jaw 100 is described. This embodiment of the clamping jaw 100 shares many of the same features provided in the clamping jaw 10 of FIGS. 1-5. Like components in this embodiment of the clamping jaw 100 operate and are positioned in a similar manner to like components of the embodiment of the clamping jaw 10 described in FIGS. 1-5. Therefore, only a brief description of the components of the clamping jaw 100 are provided. The clamping jaw 100 may include a first lever arm 102 and a second lever arm 104. It is also contemplated that the clamping jaw 100 may include one lever arm. In another aspect, the clamping jaw 10 may include one lever arm 12 that rotates and one lever arm 14 that remains fixed or stationary relative to the clamping jaw 10. It is also contemplated that, instead of fixing the second lever arm 14, another fixed component may be used in conjunction with one lever arm. The first lever arm 102 may include an outer body member 106 and an inner body member 108. The second lever arm 104 may include an outer body 110 and an inner body 112. The first lever arm 102 and the second lever arm 104 may be rotatable about a pivot point 114. This single pivot point 114 of the clamping jaw 100 is different from the first and second pivot points 16 and 18 of the clamping jaw 10 of FIGS. 1-5. By providing a single pivot point 114, the material and components of the clamping jaw 100 may be reduced and maintenance of the working parts of the clamping jaw 100 may be improved. Further, the entire clamping jaw 100 may pivot about the single pivot point 114, thereby creating a self-alignment feature if the guide rail is moved out of place from a normal operating position. The entire clamping jaw 100 may rotate about the single pivot point 114 to align with the guide rail regardless of its operational position. With less moving parts in this clamping jaw 100, there is a reduced risk of malfunction or failure of the clamping jaw 100. A first roller 116 and a second roller 118 may be positioned on the outer bodies 106 and 110 of the first and second lever arms 102, 104, respectively. The first roller 116 and the second roller 118 may be rotatably supported on the first and second lever arms 102, 104. It is also contemplated that the clamping jaw 100 may include one roller positioned in one recess on a lever arm.

A cam member 120 may be provided in the clamping jaw 100 and may include a first angled surface 122 and a second angled surface 124. The first roller 116 may bear against and move along the first angled surface 122 of the cam member 120. The second roller 118 may bear against and move along the second angled surface 124. A first end of a resilient member 126 may be provided against a surface of the cam member 120. A plate member 128 may be positioned against the resilient member 126 at a second end of the resilient member 126 opposite the cam member 120. A retaining member 130 may extend through the first and second lever arms 102, 104, through the cam member 120, through the resilient member 126 and through the plate member 128. An adjustment nut 132 may be threadedly attached to an end of the retaining member 130 to hold the components of the clamping jaw 100 together. The adjustment nut 132 may be rotated in one direction to tighten the components of the clamping jaw 100 together or rotated in an opposite direction to loosen the components of the clamping jaw 100.

With continued reference to FIG. 6, a first wedge member 134 and a second wedge member 136 may be provided on ends of the first and second lever arms 102, 104, respectively. It is also contemplated that the clamping jaw 100 include one wedge member on one lever arm. The first wedge member 134 may be positioned in a first roller bearing 138 in a similar manner as described above in relation to the first wedge member 60 and the first roller bearing 70 of the clamping jaw 10 of FIGS. 1-5. Likewise, the second wedge member 136 may be positioned in a second roller bearing 140 in a similar manner as described above in relation to the second wedge member 62 and the second roller bearing 72 of the clamping jaw 10 of FIGS. 1-5. The first roller bearing 138 may be provided on the first lever arm 102 in a similar manner as the first roller bearing 70 on the first lever arm 12 described hereinabove with the clamping jaw 10 of FIGS. 1-5. The second roller bearing 140 may be provided on the second lever arm 104 in a similar manner as the second roller bearing 72 on the second lever arm 14 described hereinabove with clamping jaw 10 of FIGS. 1-5.

With descriptions of various embodiments of the clamping jaw 10, 100 previously described, the operation and method of use of the clamping jaw 10, 100 is now described with reference to FIGS. 4 and 5. During operation, the clamping jaw 10 may be configured for use in at least two different positions. In a first position, shown in FIG. 4, the clamping jaw 10 may be positioned in an unclamped or non-applied position. In this first position, the clamping jaw 10 does not engage the guide rail 64 of the elevator arrangement. In a second position, shown in FIG. 5, the clamping jaw 10 may be moved into a clamped or applied position. In this second position, the clamping jaw 10 engages the guide rail 64 of the elevator arrangement to apply a clamping or braking force to the guide rail 64 to reduce the speed of the elevator arrangement. In typical elevator arrangement, at least two guide rails will normally be used to move an elevator car within a building to keep an even balance of braking forces on opposing sides of the elevator arrangement. It is also to be understood that some elevator arrangements may include more than two guide rails. It is also to be understood that some elevator arrangements may include one guide rail. However, the guide rails may be provided in pairs so as to avoid an imbalance of braking forces on the elevator arrangement. For these elevator arrangements, it is contemplated that a clamping jaw 10 may be positioned on each guide rail and connected to one another via a cross member (not shown).

During operation of the elevator arrangement, as the elevator arrangement is moved upwards or downwards after passengers have entered or exited the elevator, the clamping jaw 10 is positioned in the first position to allow the clamping jaw 10 to move along the guide rail 64. When the elevator arrangement is signaled for a stop or exceeds a predetermined maximum traveling speed, a governor activation member (not shown) is triggered to pull or push the first and second wedge members 60, 62 in an upwards direction relative to the guide rail 64. The governor activation member may be connected to the first and second wedge members 60, 62 in any number of ways, including pins, wire ropes, welding, fasteners, or formed as an integral part of the first and second wedge members 60, 62. It is also to be understood that the governor activation member may be positioned so as to push the first and second wedge members 60, 62 upwards relative to the guide rail 64 when the governor activation member is triggered. In one aspect, the governor activation member may be an over-speed governor activation member configured to automatically pull or push the first and second wedge members 60, 62 when the elevator arrangement exceeds a predetermined traveling speed.

As the first and second wedge members 60, 62 are pulled or pushed upwards by the governor activation member, the first and second wedge members 60, 62 slide upwards in the first and second roller bearings 70, 72. The first and second roller bearings 70, 72 may also move upwards relative to the first and second lever arms 12, 14 along extension members 82, 86. As the first and second wedge members 60, 62 continue to be pushed/pulled upwards in a direction parallel to the guide rail 64, the bearing surfaces 66, 68 of the first and second wedge members 60, 62, respectively, begin to contact the guide rail 64 of the elevator arrangement. As the larger bottom portions of the first and second wedge members 60, 62 are moved further upwards relative to the guide rail 64, a high clamping or braking force is applied to the guide rail 64 to effect a deceleration in the speed of the elevator arrangement. Due to high frictional forces generated between the wedge members 60, 62 and the guide rail 64, the elevator arrangement may experience a reduction in traveling speed. The first and second wedge members 60, 62 are pushed/pulled upwards until the desired deceleration of the elevator's arrangement is achieved. The high frictional surfaces of the bearing surfaces 66, 68 of the first and second wedge members 60, 62 assist in decelerating the elevator arrangement by creating high frictional forces between the first and second wedge members 60, 62 and the guide rail 64.

As the larger bottom portions of the first and second wedge members 60, 62 begin to contact the guide rail 64, the first and second wedges 60, 62 push the first and second lever arms 12, 14 outwards relative to the guide rail 64. The first and second lever arms 12, 14 rotate about the first and second pivot points 16, 18. The further upwards the first and second wedge members 60, 62 are pushed/pulled, the further the first and second lever arms 12, 14 are pushed outwards relative to the guide rail 64. In this aspect, the first and second wedge members 60, 62 push the outer body members 20, 24 of the first and second lever arms 12, 14, respectively, outwards relative to the guide rail 64.

As the first and second lever arms 12, 14 are rotated, the first and second rollers 28, 32 are moved inwards relative to the clamping jaw 10 along the first and second angled surfaces 38, 40, respectively, of the cam member 36. While the first and second rollers 28, 32 are moved along the first and second angled surfaces 38, 40, respectively, of the cam member 36, the cam member 36 is moved in an outer direction towards the resilient member 54 so as to compress the resilient member 54. The further the first and second rollers 28, 32 are moved inwards along the first and second angled surfaces 38, 40, the further the cam member 36 is pushed towards the resilient member 54 and the further the resilient member 54 is compressed. The resilient member 54 bears against the plate member 56 to allow a partial or full compression of the resilient member 54 depending on how far the cam member 36 is moved outwards. The resilient member 54 may be compressed to its pre-set value, after which all of the clamping or braking force is transferred to the first and second wedges 60, 62 to be applied to the guide rail 64. In this manner, the elevator arrangement may decelerate its speed to either reduce the traveling speed of the elevator arrangement or bring the elevator arrangement to a stop. It is also to be understood that the clamping jaw 100 of FIG. 6 operates in a similar manner, except the first and second lever arms 102, 104 rotate about the single pivot point 114 whenever the first and second wedge members 134, 136 are pulled/pushed upwards along the guide rail 64.

Figure 7:
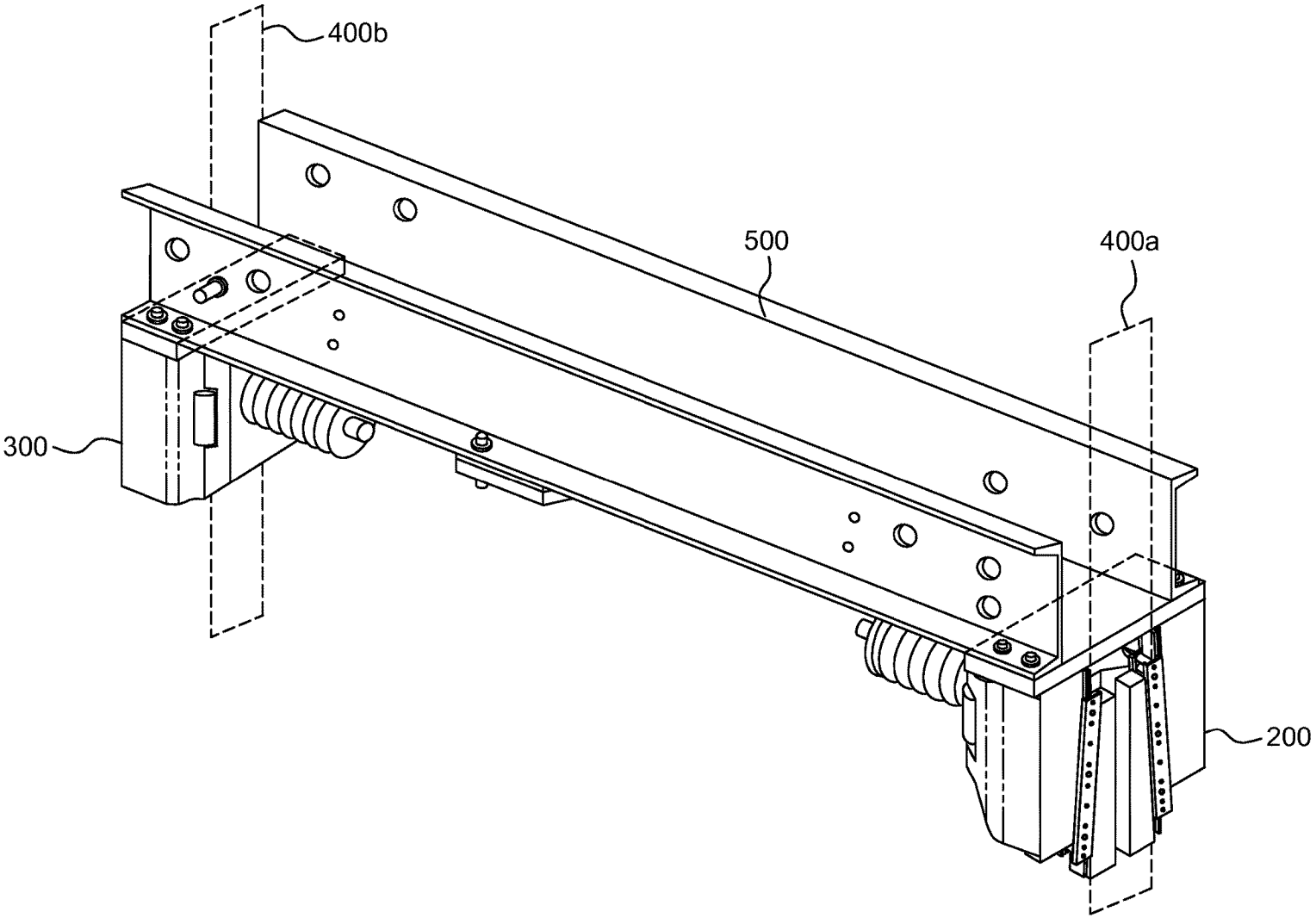
FIG. 7 is a front perspective view of an elevator arrangement with clamping jaws in accordance with an aspect of this disclosure.

With reference to FIG. 7, the use of at least two clamping jaws 200, 300 with an elevator arrangement is described. The clamping jaws 200, 300 shown in FIG. 7 may be the same as the clamping jaw 10 shown in FIGS. 1-5. It is also contemplated that the clamping jaws 200, 300 may be the same as the clamping jaw 100 shown in FIG. 6. The clamping jaws 200, 300 may be positioned around a corresponding guide rail 400*a*, 400*b*, respectively, to reduce the traveling speed of the elevator arrangement. The clamping jaws 200, 300 may decelerate the elevator arrangement in a similar manner as described hereinabove with clamping jaws 10, 100. In this configuration, the clamping jaws 200, 300 may be positioned on opposing ends of a cross-member 500 of the elevator arrangement. The clamping jaws 200, 300 may be fastened, welded, adhesively attached, or otherwise positioned on the cross-member 500. In operation, the clamping jaws 200, 300 may be configured to work simultaneously, so that once one clamping jaw 200 is activated, the opposing clamping jaw 300 is also activated. In this manner, the traveling speed of the elevator arrangement may be reduced in a uniform manner. By using at least two clamping jaws 200, 300, the elevator arrangement may be brought to a stop in a shorter amount of time than typical elevator arrangements. It is to be understood, however, that more than two clamping jaws may be provided in the elevator arrangement, thereby providing an additional amount of braking force.

By using a clamping jaw 10 in this manner, several advantages are achieved in decelerating the elevator arrangement. The clamping jaw 10 may be self-locking. Therefore, after the initial activation of the clamping jaw 10 via the governor activation member, the clamping jaw 10 does not require an additional pull force from the governor activation member to generate the clamping or braking force or to stay engaged after initial activation. The clamping or braking force of the clamping jaw 10 may also be adjustable so as to allow use on any size elevator arrangement and/or guide rail. The resilient member 54 may be pre-loaded to different amounts of pressure; the size of the resilient member 54 may be altered; the first and second angled surfaces 38, 40 of the cam member 36 may be altered to different angles; and/or the size of the first and second rollers 28, 30 may be altered to create a larger or smaller clamping and braking force as is required by the elevator arrangement. A further advantage of the clamping jaw 10 is that the resilient member 54 may be pre-set at the factory where the clamping jaw 10 is manufactured so that the clamping or braking force of the clamping jaw 10 is also pre-set based on the mass and passenger capacity of the elevator arrangement. By pre-setting the clamping or braking force, a more accurate clamping or braking force may be applied to the elevator arrangement, as desired. Further, by self-locking the clamping jaw 10, the clamping jaw 10 may apply a constant clamping or braking force to the guide rail 64 after the initial adjustment from the governor activation member to effect a predictable deceleration rate for the elevator arrangement. Due to the constant clamping or braking force, the rate of deceleration for the elevator arrangement may also be constant.

Further advantages are also gained from the use of the clamping jaw 10. With pre-existing clamping jaws, a mechanical advantage for the resilient member is gained by having a long lever arm for the resilient member and a short lever arm for the wedge member, thereby multiplying the resilient member force by the ratio of lever arms. The lower the mechanical advantage seen by the resilient member, the larger the resilient member must be to produce the necessary clamping or braking force. By using the clamping jaw 10 of the present disclosure, however, a high clamping or braking force is generated through the use of the first and second lever arms 12, 14 with the first and second rollers 28, 32 and the first and second angled surfaces 38, 40 of the cam member 36 that activates the resilient member 54. The angle of the first and second angled surfaces 38, 40 may be altered to increase or decrease the mechanical advantage experienced by the resilient member 54, thereby reducing the mass and size of the resilient member and lever arm that are required for the necessary clamping or braking force. The clamping jaw 10 of this disclosure utilizes a smaller lever arm with a roller to gain the same mechanical advantage experienced with a larger lever arm by using an effectively designed angled surface for the cam member 36. In turn, the use of the clamping jaw 10 reduces the resilient member size and mass that is required to achieve the high clamping or braking force. By providing low moving mass components in the clamping jaw 10, the clamping jaw 10 is advantageous for use in a high speed elevator arrangement that preferably does not operate with heavier clamping jaws that may weigh the elevator arrangement down as it is accelerated. Further, due to the speed in which the clamping or braking force is applied after the governor activation member pulls/pushes the first and second wedge members 60, 62, the clamping jaw 10 further assists in quickly reducing the speed of a high speed elevator arrangement due to a shorter actuation response delay.

While several embodiments of the clamping jaw 10, 100 are shown in the accompanying figures and described in detail hereinabove, other embodiments will be apparent to, and readily made by, those skilled in the art without departing from the scope and spirit of the disclosure. Accordingly, the foregoing description is intended to be illustrative rather than restrictive. The invention described hereinabove is defined by the appended claims and all changes to the invention that fall within the meaning and range of equivalency of the claims are to be embraced within their scope.

The invention claimed is:

1. A safety clamping jaw for engaging a guide rail, comprising:

at least two lever arms, wherein the at least two lever arms comprise a first lever arm and a second lever arm, and wherein each lever arm is rotatable about a pivot point provided on each corresponding lever arm, a wedge member provided on a first end of each lever arm, a roller provided on a second end of each lever arm, a cam member provided between the rollers, a resilient member bearing against the cam member, and an inner body extending from the pivot point of the first lever arm and the pivot point of the second lever arm, the cam member pressing against the inner body, wherein, upon movement of the wedge members substantially parallel to a longitudinal axis of the guide rail to clamp the guide rail therebetween, each roller pushes the cam member in a direction towards the resilient member, thereby compressing the resilient member and creating a gap between the inner body and the cam member.

2. The safety clamping jaw as claimed in claim 1, the cam member comprising a first angled surface and a second angled surface, and wherein the roller provided on the first lever arm bears against the first angled surface and the roller provided on the second lever arm bears against the second angled surface.

3. The safety clamping jaw as claimed in claim 1, the resilient member comprising a spring.

4. The safety clamping jaw as claimed in claim 1, further comprising a retaining member that extends through the at least two lever arms, the cam member, the inner body, and the resilient member to hold the clamping jaw together.

5. The safety clamping jaw as claimed in claim 1, each wedge member comprising a first end and a second end, and wherein the first end of each wedge member has a larger cross-sectional area than the second end of each wedge member.

6. The safety clamping jaw as claimed in claim 1, further comprising a roller bearing positioned on the first end of each lever arm, and wherein each roller bearing is positioned between the first end of each lever arm and each wedge member positioned on the first end of each lever arm.

7. The safety clamping jaw as claimed in claim 1, wherein each wedge member comprises a high friction material.

8. An elevator arrangement to engage the guide rail, comprising:

at least one guide rail, and at least one safety clamping jaw provided adjacent each guide rail, the at least one safety clamping jaw comprising:

at least two lever arms, wherein the at least two lever arms comprise a first lever arm and a second lever arm, and wherein each lever arm is rotatable about a pivot point provided on each corresponding lever arm, a wedge member provided on a first end of each lever arm, a roller provided on a second end of each lever arm, a cam member provided between the rollers, a resilient member bearing against the cam member, and an inner body extending from the pivot point of the first lever arm and the pivot point of the second lever arm, the cam member pressing against the inner body, wherein, upon movement of the wedge members substantially parallel to a longitudinal axis of the guide rail to clamp the guide rail therebetween, each roller pushes the cam member in a direction towards the resilient member, thereby compressing the resilient member and creating a gap between the inner body and the cam member.

9. The elevator arrangement as claimed in claim 8, the cam member comprising a first angled surface and a second angled surface, and wherein the roller provided on the first lever arm bears against the first angled surface and the roller provided on the second lever arm bears against the second angled surface.

10. The elevator arrangement as claimed in claim 8, the resilient member comprising a spring.

11. The elevator arrangement as claimed in claim 8, further comprising a retaining member that extends through the at least two lever arms, the cam member, the inner body, and the resilient member to hold the clamping jaw together.

12. The elevator arrangement as claimed in claim 8, each wedge member comprising a first end and a second end, and wherein the first end of each wedge member has a larger cross-sectional area than the second end of each wedge member.

13. The elevator arrangement as claimed in claim 8, further comprising a roller bearing positioned on the first end of each lever arm, and wherein each roller bearing is positioned between the first end of each lever arm and each wedge member positioned on the first end of each lever arm.

14. The elevator arrangement as claimed in claim 8, wherein each wedge member comprises a high friction material.

15. A method of decelerating an elevator arrangement using at least one safety clamping jaw, comprising the steps of:

a) providing the elevator arrangement, the elevator arrangement comprising:

at least one guide rail, and at least one safety clamping jaw provided adjacent each guide rail, the at least one safety clamping jaw comprising:

at least two lever arms, wherein the at least two lever arms comprise a first lever arm and a second lever arm, and wherein each lever arm is rotatable about a pivot point provided on each corresponding lever arm, a wedge member provided on a first end of each lever arm, a roller provided on a second end of each lever arm, a cam member provided between the rollers, a resilient member bearing against the cam member, and an inner body extending from the pivot point of the first lever arm and the pivot point of the second lever arm, the cam member pressing against the inner body; and b) moving each wedge member in a direction substantially parallel to each corresponding guide rail to bring each wedge member in contact with each corresponding guide rail, thereby clamping each wedge member against each corresponding guide rail and compressing the resilient member by pushing each roller against the cam member in a direction towards the resilient member, thereby creating a gap between the inner body and the cam member.

16. The method of decelerating an elevator arrangement as claimed in claim 15, further comprising the step of rotating the lever arms relative to one another.

17. The method of decelerating an elevator arrangement as claimed in claim 16, further comprising the step of pushing the rollers along a length of the cam member.

18. The method of decelerating an elevator arrangement as claimed in claim 17, further comprising the step of pushing the cam member against the resilient member.

19. The method of decelerating an elevator arrangement as claimed in claim 18, further comprising the step of compressing the resilient member.

* * * * *